United States Patent [19]

Southern et al.

[11] Patent Number: 4,831,656

[45] Date of Patent: May 16, 1989

[54] CONFERENCE MICROPHONE FOR USE WITH HEARING IMPAIRED AMPLIFICATION SYSTEM

[76] Inventors: Robert R. Southern, 205 Rockland Ave., River Vale, N.J. 07675; Michael R. Treni, 248 N. Central Ave., Ramsey, N.J. 07446

[21] Appl. No.: 94,457

[22] Filed: Sep. 9, 1987

[51] Int. Cl.[4] ..... H04R 3/00

[52] U.S. Cl. ..... 381/169; 381/160

[58] Field of Search ..... 381/160, 168, 169, 188, 381/205; 455/95, 128

[56] References Cited

U.S. PATENT DOCUMENTS 4,434,507 2/1984 Thomas ..... 381/160 X

*Primary Examiner*—Steven Mottola

*Attorney, Agent, or Firm*—Richard A. Joel

[57] ABSTRACT

This invention comprises a device for transducing the speech of a conference group gathered about a table. It is capable of wireless operation for use with hearing impaired amplification systems and remote conference recording. The device combines an acoustically controlled microphone and antenna system in a single unit with no visible wires, antenna, or electronics. Specifically, a single condenser microphone is mounted at the end of the frustoconical member which is suspended above and perpendicular to a horizontal reflector plate. The diaphragm of the microphone is parallel to the table top. The reflector plate also functions as an antenna in radio versions of the device. An opening at a predetermined specific angle between the cone and reflector plate deflects the sound waves eminating from any conversations about the table directly into the microphone causing it to produce a higher electrical output for those frequencies produced by the human voice. The opening to the microphone is the same from any side of the device producing uniform directional characteristics so that all conference participants can be heard equally well.

2 Claims, 3 Drawing Sheets

CONFERENCE MICROPHONE FOR USE WITH HEARING IMPAIRED AMPLIFICATION SYSTEM

BACKGROUND OF THE INVENTION

Hearing impaired individuals who attend conference-type meetings generally have difficulty hearing everyone at the table. Even people with only moderately impaired hearing, and who do not wear hearing aids, are often in need of amplification.

Sound reinforcement, if available, requires setting up microphones and cables, often creating an uncomfortable meeting environment. The arrangement is rarely effective for the hearing impaired person and may even create adverse acoustics for the normal hearing participants.

People who wear hearing aids also have a difficult time hearing, even though they have personal amplification. This is because of the placement of the hearing aid which most people wear behind the ear. In a conference situation, the micropone of the hearing aid is behind the listener and facing away from the table. Since the microphone is not in the direct path of the sound waves produced by the meeting participants it picks them up after they have been reflected off another surface such as a wall. These reflected waves, arriving at different times, are out of phase causing distortion.

Another problem is that meeting participants are at varying distances from the hearing aid microphone. Those individuals that are closer to the hearing aid will sound louder than those that are further away.

Still another problem caused by hearing aids is that environmental noise is amplified at the same rate as the desired signal. The result is a low signal to noise ratio where noise and distortion are almost indistinguishable from the sound the listener wishes to hear.

To overcome these problems, the hearing aid microphone would ideally have to be located in the center of the table directly in the path of the sound waves crossing the table and equidistant from all speakers. Additionally, the microphone should be designed to favor the desired sound waves while reducing those that are undesirable. The simplest way to accomplish this objective is to establish directional characteristics for the microphone that are optimally effective for this type of acoustic environment.

Finally, the microphone needs to be capable of wireless operation so that people can move freely about the conference table without the presence of annoying wires. Such a device would also be useful for sound reinforcement and recording providing performance that is superior to conventional microphones, as well as the convenience of wireless operation.

The prior art includes U.S. Pat. No. 4,361,736 to Long which describes a pressure responsive acoustical insulated microphone diaphragm closely spaced to a boundary and adapted to receive sound waves only through that space in order to provide realistic multi-directional sound reproduction with the ability to acoustically filter and cancel unwanted signals in the higher frequency range. Although the Long patent does mention a microphone closely spaced to a boundary that is parallel to the table top; it does not disclose a cone suspended above and perpendicular to such boundary which produces a higher electrical output of voice frequencies and specific directional characteristics for a conference environment, or a structurally integrated antenna system for wireless operation.

Also of interest are U.S. Pat. No. 2,544,536 to A. H. Kettler pertaining to a micropnone and U.S. Pat. No. 2,577,288 to E. H. Terlinde on an acordian microphone. It should be pointed out that the cone in the applicants' invention has an entirely different function from the cone-shaped portion of the Terlinde patent. In the latter patent there are several openings for the sound to enter, whereas applicants' cone functions as a vertical boundary by providing only one opening through which the sound may pass.

U.S. Pat. Nos. 3,496,297 to R. Brumberger and 2,267,353 to G. Lahovsky are considered to be of marginal interest. Finally, U.S. Pat. No. 3,870,820 to Suzuki et al discloses a built-in microphone for a tape recorder. None of the foregoing patents is believed relevant enough to affect the patentability of the present invention which is clearly an improvement over the prior art since it is uniquely suited to meet the objectives of a wireless conference microphone.

SUMMARY OF THE INVENTION

The present invention comprises an octangular unit which employs a single condenser microphone mounted at the end of a cone. The cone is suspended above a reflector plate by four posts with the top part of the cone providing a surface for the transmitter mounting assembly and electrical connections. The cone which is perpendicular to the plate functions as a significant vertical boundary which deflects the sound waves into the opening of the microphone at the apex of the cone. The diaphragm of the microphone is parallel to the table top. The reflector plate functions as a horizontal boundary and also as part of the antenna system. A decorative wood enclosure covers the top of the cone concealing wires and electronics from view and providing additional isolation for the microphone from extraneous sound waves.

The predetermined 22 degree angle of the opening between the cone and the reflector plate controls the microphone's environment by deflecting the sound waves produced by conversations into the microphone mounted within the aperture of the cone. As a result of this design, these sound waves enter the microphones directly causing the microphone to produce a significantly higher electrical output in the voice frequency range. By contrast, random sound waves coming from vertical angles enter the microphone indirectly which in turn produces a lower electrical output.

The angle between the cone and reflector plate also produces uniform directional characteristics for the microphone. The 22 degree opening from the sides of the unit is the same at any point in a 360 degree plane creating a horizontal pattern that is uniformially omni-directional. By contrast, the vertical pattern is uni-directional due to the isolation offered by the mass of the cone and the octagonal cover.

The output of the microphone is connected to a commercially available transmitter unit which converts the signal to radio, magnetic, or infrared light waves. Although such transmission devices are beyond the scope of the protection sought by this patent, it is important to mention them in so far as they relate to the antenna system of the applicant's invention. Transmitters that emit radio waves or magnetic fields normally employ a metal rod or wire cable as an antenna. The applicants' invention is unique in that the reflector plate functions as an antenna thereby eliminating the necessity for any protruding rods or wires.

Amplification of the signal is accomplished by using radio receivers, amplifiers, and hearing aids. Hearing impaired listeners can raise and lower the volumes as required while still preserving the favorable ratio of speech signal to incidental noise provided by the applicant's device.

Accordingly, the object of this invention is to provide a new and improved microphone for conference tables that can be used by hearing impaired persons in personal amplification systems.

Another object of this invention is to provide a new and improved conference microphone which includes an integral antenna system and provisions for a transmitting unit that will provide wireless operation.

Another object of the invention is to provide a new and improved wireless conference microphone that can be used for recording and sound reinforcement.

A more specific object of this invention is to provide a new and improved microphone utilizing a conical vertical boundry that is suspended above and parallel to a reflector plate, with a microphone mounted in an aperture at the apex of the conical boundry, with said microphone parallel to the reflector plate, which is in turn parallel to the surface of the conference table, and said microphone producing a significantly higher output of frequencies in the voice range.

BRIEF DESCRIPTION OF THE DRAWINGS

Other objects and advantages of the present invention will be more clearly understood when viewed in conjunction with the drawings wherein.

DETAILED DESCRIPTION OF THE INVENTION

Figure 1:
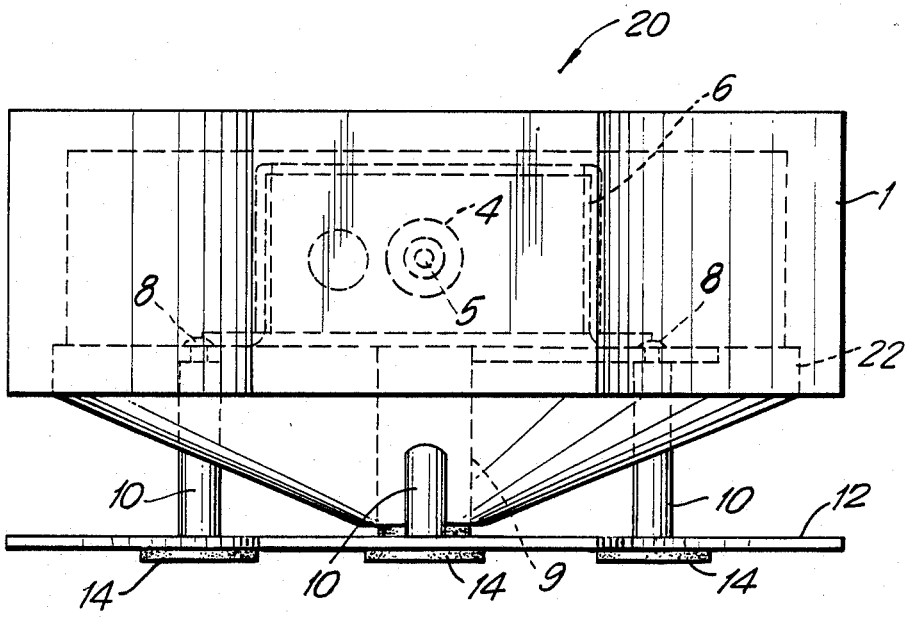
FIG. 1 is a schematic side view of the invention illustrating the configuration of the device comprising the invention.
Figure 2:
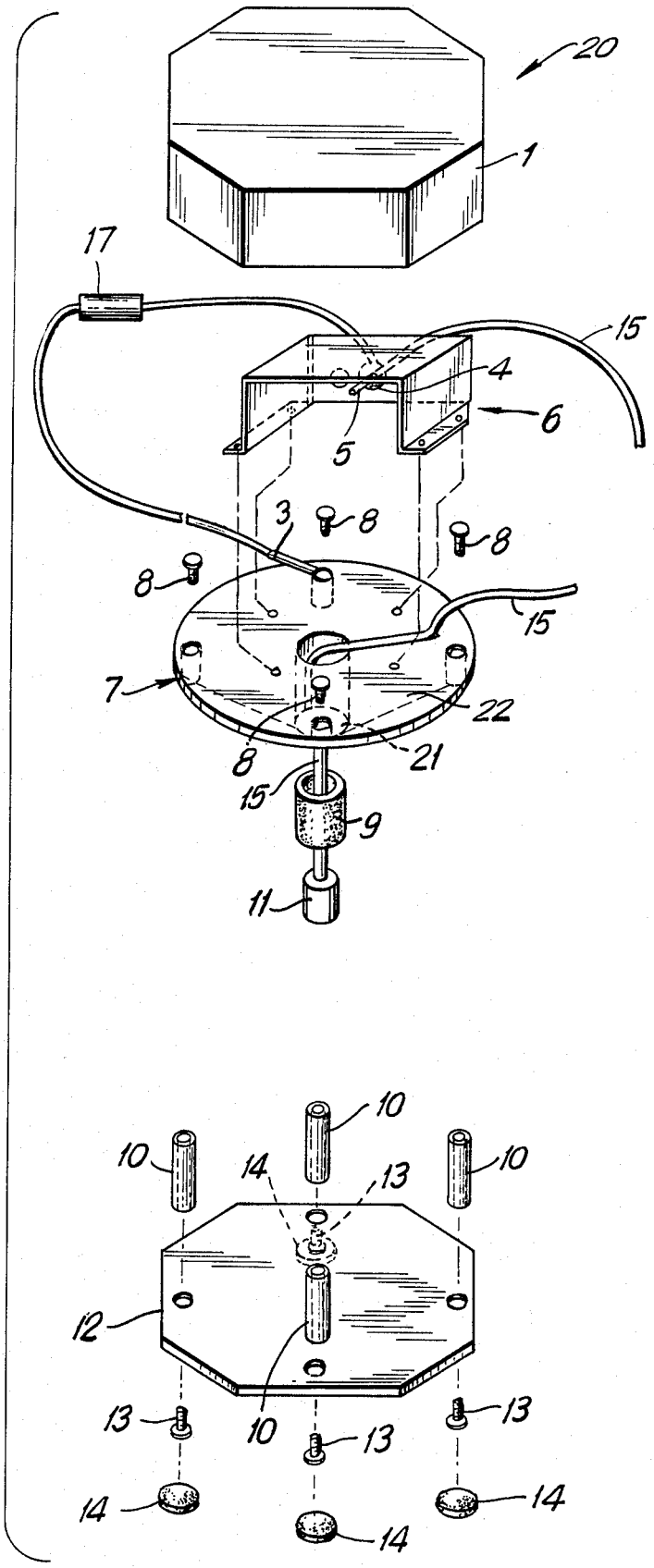
FIG. 2 is an exploded view of the invention.

Referring now to the drawings, the invention comprises a unit 20 for transducing the speech of a conference group seated about a table (not shown). The unit 20 includes an octagonal housing 1 having a single condenser microphone 11, surrounded by an isolating rubber sleeve 9 and mounted in an aperture 21 at the apex of an inverted frustoconical member.

The cone or frusticonical member 7 is axially perpendicular to and suspended above a reflector plate 12 by four posts 10 which are affixed at their upper end to the base 22 of the frustoconical member 7 by screws 8 and at their lower end to the reflector plate by screws 13. Rubber pads 14 mounted on the bottom of the reflector plate 12 isolate the unit 10 from the transmission of mechanical vibrations from the table. The angle 23 of the opening 21 between the cone 7 and the reflector plate 12 is a predetermined 22 degree angle which deflects the sound waves produced by conversations into the recessed microphone 11 within opening 22. As a result of this design, sound waves coming from other directions cannot enter the microphone 11 directly. The voice waves enter the microphone 11 directly producing a higher electrical output in these frequencies. By contrast, the random sounds enter the microphone 11 indirectly and have a significant lower output. Thus, it is possible to amplify conversations for the hearing impaired without the usual distortion of random sounds.

A transmitter mounting assembly 6 is mounted on the upper surface of the frustoconical member 7 and includes the transmitter mounting bracket having an isolating grommet 4 and audio connector 5 mounted in the wall thereof. The audio connector 5 is coupled to the microphone by a cable 15 which extends through the aperture 21 in the cone 7.

One end of a tuning coil 17 is connected to the ground side of the audio connector 5 and the other end is connected to a lug 3. A screw 8 completes the electrical connection between the lug 3 and one of the four posts 10 supporting the cone 7 which is in turn connected to the reflector plate 12 so that it functions as an antenna. The decorative wood housing 1 covers the transmitter assembly and wires.

Figure 3:
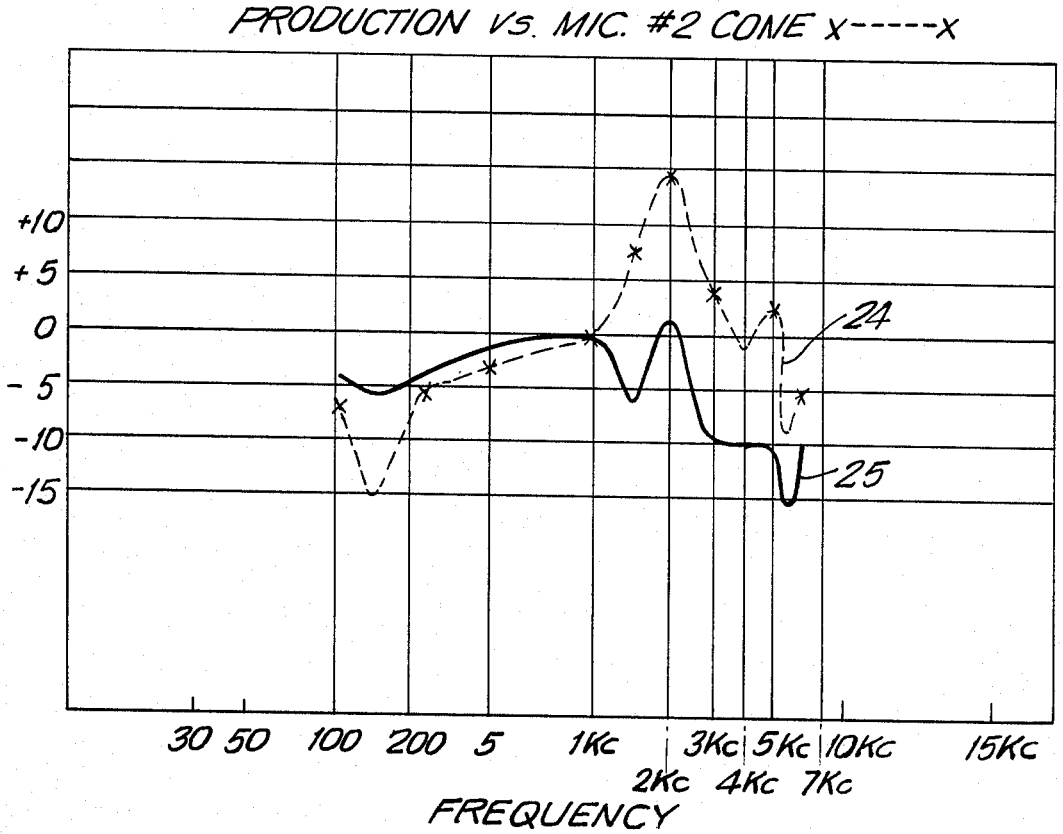
FIG. 3 is a graph illustrating the output of a condenser microphone cartridge mounted within the invention, versus the same condenser microphone cartridge in free air, and, FIG. 4 is a perspective view of the invention.
Figure 4:
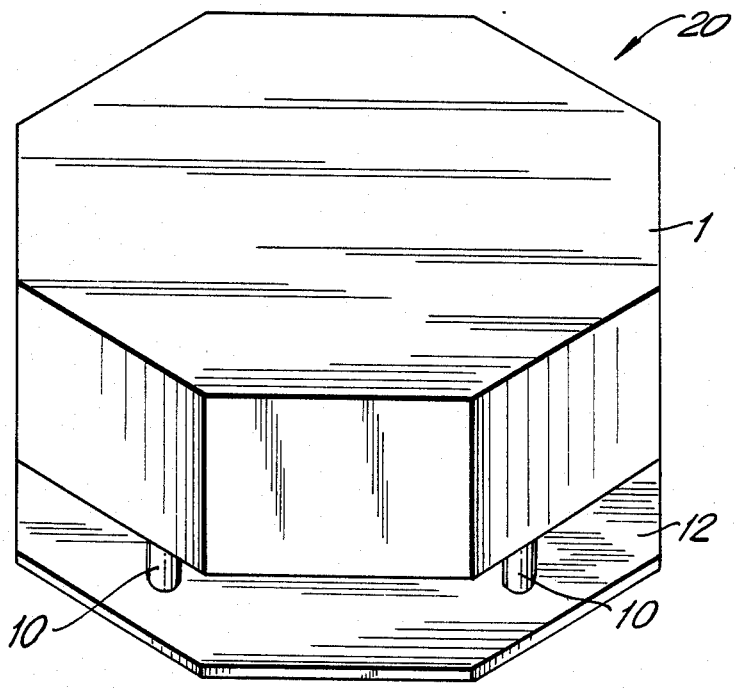

FIG. 3 depicts the improved amplification represented by the dotted line 24 which occurs with a condenser microphone cartridge mounted within applicant's cone mounting arrangement, particularly within voice frequencies. The solid line 25 represents the same microphone cartridge in free air. The graph clearly illustrates the higher output in the desired frequency range.

The conference unit 10 also provides uniform omnidirectional capabilities for the microphone 12. The opening 22 from the sides of the unit 12 is the same at any point in a 360 degree plane creating a horizontal pattern that in uniformally omni-directional. On the other hand, the vertical pattern of the microphone 12 is uni-directional due to the isolation offered by the restructured opening to the microphone 12.

The output of the microphone 11 is connected to a small transmitter (not shown) that converts the signal to radio, magnetic, or infrared light waves. Although such transmission devices are beyond the scope of the protection sought by this patent, it is important to mention them insofar as they relate to the antenna system of the applicant's invention. Transmitters that emit radio waves or magnetic fields normally employ a metal rod or wire cvable as an antenna. The applicant's invention is unique in that the output of the transmitter is connected to one of the four posts 10 supporting the cone 7, which conducts the signal to the metal reflector plate 12. The reflector plate 12 in turn functions as an antenna thereby eliminating the necessity for any protruding rods or wires. Transmitters that emit infrared light do not require an antenna but rather emit their signal through light emitting diodes (LED). Provisions for employing this type of transmitter have been made by providing space for one or more LEDs on each of the eight sides of the enclosure.

Amplification of the signal is accomplished by using radio or infrared receivers, amplifiers and hearing aids. Hearing impaired listeners can raise or lower the volume as required while still preserving the favorable ratio of speech frequencies while still preserving the favorable ratio of speech frequencies to incidental noise provided by the applicants' device.

It is understood that the above-described arrangements are merely illustrative examples of the application. Numerous other arrangements may be readily devised by those skilled in the art which will embody the principles of the invention and fall within the spirit and scope thereof.

What is claimed is:

1. A conference microphone comprising a housing, having a top and downwardly extending sides, a transmitter assembly mounted within the housing, said assembly including transmitting means, an inverted frustoconical member having an upper base and downwardly extending sides, and an apperture extending axially through said member a microphone mounted within the aperture in the cone, said microphone having a cable extending upwardly therefrom through the aperture in the base and being connected to the transmitting means, and a reflector plate mounted a predetermined distance from the lower portion of the opening in the frustoconical member in the transmitter assembly wherein, the sides of the frustoconical member are mounted at an angle of approximately 22 degres to the reflector plate to minimize the pick-up of unwanted sounds by the microphone, said microphone being mounted parallel to the reflector plate within the frustoconical member.

2. A conference microphone in accordance with claim 1 wherein:

the frustoconical member includes sides which extend downwardly from the sides of the housing providing an opening to the microphone which is the same at any point in a 360 degree plane thereby providing a horizontal sound pattern that is uniformly omni-directional.

* * * * *